US008337268B2

(12) United States Patent
Below et al.

(10) Patent No.: US 8,337,268 B2
(45) Date of Patent: Dec. 25, 2012

(54) METHOD OF MAKING SPARK PLUG CASING AND SPARK PLUG HAVING THE SPARK PLUG CASING

(75) Inventors: Matthew B. Below, Findlay, OH (US); J. Braden Richards, Findlay, OH (US)

(73) Assignee: Fram Group IP LLC, Lake Forest, IL (US)

( * ) Notice: Subject to any disclaimer, the term of this patent is extended or adjusted under 35 U.S.C. 154(b) by 0 days.

(21) Appl. No.: 13/270,642

(22) Filed: Oct. 11, 2011

(65) Prior Publication Data

US 2012/0264344 A1 Oct. 18, 2012

Related U.S. Application Data

(62) Division of application No. 12/263,716, filed on Nov. 3, 2008, now Pat. No. 8,035,286.

(60) Provisional application No. 60/985,022, filed on Nov. 2, 2007.

(51) Int. Cl.
*H01T 21/02* (2006.01)
*H01T 13/20* (2006.01)
*H01T 13/02* (2006.01)

(52) U.S. Cl. ..... 445/7; 313/118; 313/141; 313/143; 313/144; 123/169 EL

(58) Field of Classification Search ..... None
See application file for complete search history.

(56) References Cited

U.S. PATENT DOCUMENTS

| | | | |
|---|---|---|---|
| 3,965,384 | A | 6/1976 | Yamazaki |
| 4,250,426 | A | 2/1981 | Nakajima et al. |
| 4,808,878 | A | 2/1989 | Kashiwara et al. |
| 4,901,688 | A | 2/1990 | Kashiwara et al. |
| 4,989,557 | A | 2/1991 | Penney |
| 5,014,656 | A | 5/1991 | Leptich et al. |
| 5,091,672 | A | 2/1992 | Below |
| 5,430,346 | A | 7/1995 | Johnson |
| 5,697,334 | A | 12/1997 | Below |
| 5,918,571 | A | 7/1999 | Below |
| 5,982,079 | A | 11/1999 | Kibbey |
| 6,104,130 | A | 8/2000 | Below |
| 6,316,868 | B1 | 11/2001 | Ishino et al. |
| 6,552,476 | B1 | 4/2003 | Hanashi et al. |
| 6,667,568 | B1 | 12/2003 | Bugaets |
| 2007/0252502 | A1 | 11/2007 | Wang |

FOREIGN PATENT DOCUMENTS

JP 2001093645 A 4/2001

OTHER PUBLICATIONS

International Search Report and Written Opinion dated Mar. 31, 2009 for Application No. PCT/US2008/082203.

*Primary Examiner* — Sikha Roy
(74) *Attorney, Agent, or Firm* — Barnes & Thornburg LLP

(57) ABSTRACT

A spark plug casing includes a single-piece shell having a nut portion, first and second tubular portions and a converging shell portion, which are configured to be removed from a cylinder head as an integral device. The first tubular portion extends from the nut portion and has a first cross-sectional size. The second tubular portion has a second cross-sectional size less than the first cross-sectional size. The converging shell portion is coupled between the first and second tubular portions. The casing further includes a ground strap having a third cross-sectional size less than the second cross-sectional size. The ground strap is received within an end portion of the second tubular portion opposite the converging shell portion, such that the ground strap and the cylinder head are in a spaced relationship with respect to each other for preventing carbon buildup from binding the ground strap to the cylinder head.

16 Claims, 4 Drawing Sheets

METHOD OF MAKING SPARK PLUG CASING AND SPARK PLUG HAVING THE SPARK PLUG CASING

CROSS REFERENCE TO RELATED APPLICATIONS

This application is a divisional application of U.S. Ser. No. 12/263,716 filed Nov. 3, 2008, which claims the benefit of the following U.S. Provisional Patent application Ser. No. 60/985,022 filed Nov. 2, 2007, the contents each of which are incorporated herein by reference thereto.

BACKGROUND OF THE INVENTION

Exemplary embodiments of the present invention relate to spark plugs for internal combustion engines, and more particularly to a spark plug configured to be easily indexed and removed from the engine cylinder head.

Spark plugs include a center electrode, an insulator disposed about the center electrode and a metal casing disposed about the insulator. The casing includes a jam nut shell that is hot-pressed to an end portion of a ground shield. The ground shield has a ground strap disposed in a spaced relationship with the center electrode for defining a spark gap therebetween.

The spark plug is indexed by marking the location of the spark gap on a portion of the plug that remains visible when the plug is installed on a cylinder head and then noting the direction in which the mark faces after the plug has been installed. The plug is then removed and re-installed on the cylinder head with additional washers, such that the orientation of the tightened plug is changed for directing the spark gap toward the valves. Such indexing is typically performed individually for each plug, as the orientation of the gap with respect to the threads of the shell can be random.

The spark plug is configured to dispose the ground strap adjacent to a surface of the cylinder head, such that carbon buildup on the ground strap can bind the ground strap to the cylinder head. Accordingly, removal of the spark plug can cause the ground strap to become detached from the ground shield and remain within the cylinder head.

Accordingly, it is desirable to provide a spark plug that is configured to be easily indexed and removed from a cylinder head.

BRIEF DESCRIPTION OF THE INVENTION

In accordance with a non-limiting exemplary embodiment of the invention, a spark plug casing is provided. The spark plug casing includes a first tubular portion extending from a nut portion. The first tubular portion has a first cross-sectional size and a threaded fastener configured to attach the spark plug casing to a cylinder head. The casing further includes a second tubular portion having a second cross-sectional size. The second cross-sectional size is less than the first cross-sectional size. The second tubular portion is configured to extend toward a combustion chamber past the cylinder head. The casing further includes a converging shell portion coupled between the first tubular portion and the second tubular portion. The nut portion, the first tubular portion, the second tubular portion and the converging shell portion comprise a single-piece shell such that the single-piece shell is configured to be removed from the cylinder head as an integral device. The casing further includes a ground strap having a third cross-sectional size. The third cross-sectional size is less than the second cross-sectional size. The ground strap is received within an end portion of the second tubular portion opposite the converging shell portion, such that the ground strap and the cylinder head are in a spaced relationship with respect to each other for preventing a buildup of carbon from binding the ground strap to the cylinder head.

In accordance with another non-limiting exemplary embodiment of the present invention, a spark plug is provided. The spark plug includes a center electrode, an insulator disposed about the center electrode and a spark plug casing disposed about the insulator. The spark plug casing includes a first tubular portion extending from a nut portion. The first tubular portion has a first cross-sectional size and a threaded fastener configured to attach the spark plug casing to a cylinder head. The casing further includes a second tubular portion having a second cross-sectional size. The second cross-sectional size is less than the first cross-sectional size. The second tubular portion is configured to extend toward a combustion chamber past the cylinder head. The casing further includes a converging shell portion coupled between the first tubular portion and the second tubular portion. The nut portion, the first tubular portion, the second tubular portion and the converging shell portion comprise a single-piece shell such that the single-piece shell is configured to be removed from the cylinder head as an integral device. The casing further includes a ground strap having a third cross-sectional size. The third cross-sectional size is less than the second cross-sectional size. The ground strap is received within an end portion of the second tubular portion opposite the converging shell portion, such that the ground strap and the cylinder head are in a spaced relationship with respect to each other for preventing a buildup of carbon from binding the ground strap to the cylinder head.

In another exemplary embodiment, a method of making a spark plug casing is provided, the method including the steps of: forming a first main shell portion having a nut portion; a first tubular portion extending from the nut portion, the first tubular portion having a first cross-sectional size and a threaded fastener configured to attach the spark plug casing to a cylinder head; a second tubular portion having a second cross-sectional size, the second cross-sectional size being less than the first cross-sectional size, the second tubular portion configured to extend toward a combustion chamber past the cylinder head; and securing a converging shell portion to the first main shell portion, the converging shell portion being coupled between the first tubular portion and the second tubular portion, wherein the nut portion, the first tubular portion, the second tubular portion and the converging shell portion are formed from a single-piece shell such that the single-piece shell is configured to be removed from the cylinder head as an integral device; and a ground strap having a third cross-sectional size, the third cross-sectional size being less than the second cross-sectional size, the ground strap being received within and fixedly secured to an end portion of the second tubular portion opposite the converging shell portion, such that the ground strap and the cylinder head are in a spaced relationship with respect to each other for preventing a buildup of carbon from binding the ground strap to the cylinder head.

DETAILED DESCRIPTION OF EXEMPLARY EMBODIMENTS

Exemplary embodiments of the present invention are directed to a spark plug having a spark plug casing configured to be easily indexed and removed from a cylinder head. In these embodiments, the casing has a single-piece shell and a ground strap that is attached to the shell. However, it is contemplated that the ground strap can instead be an integral portion of the single-piece shell.

Figure 1:
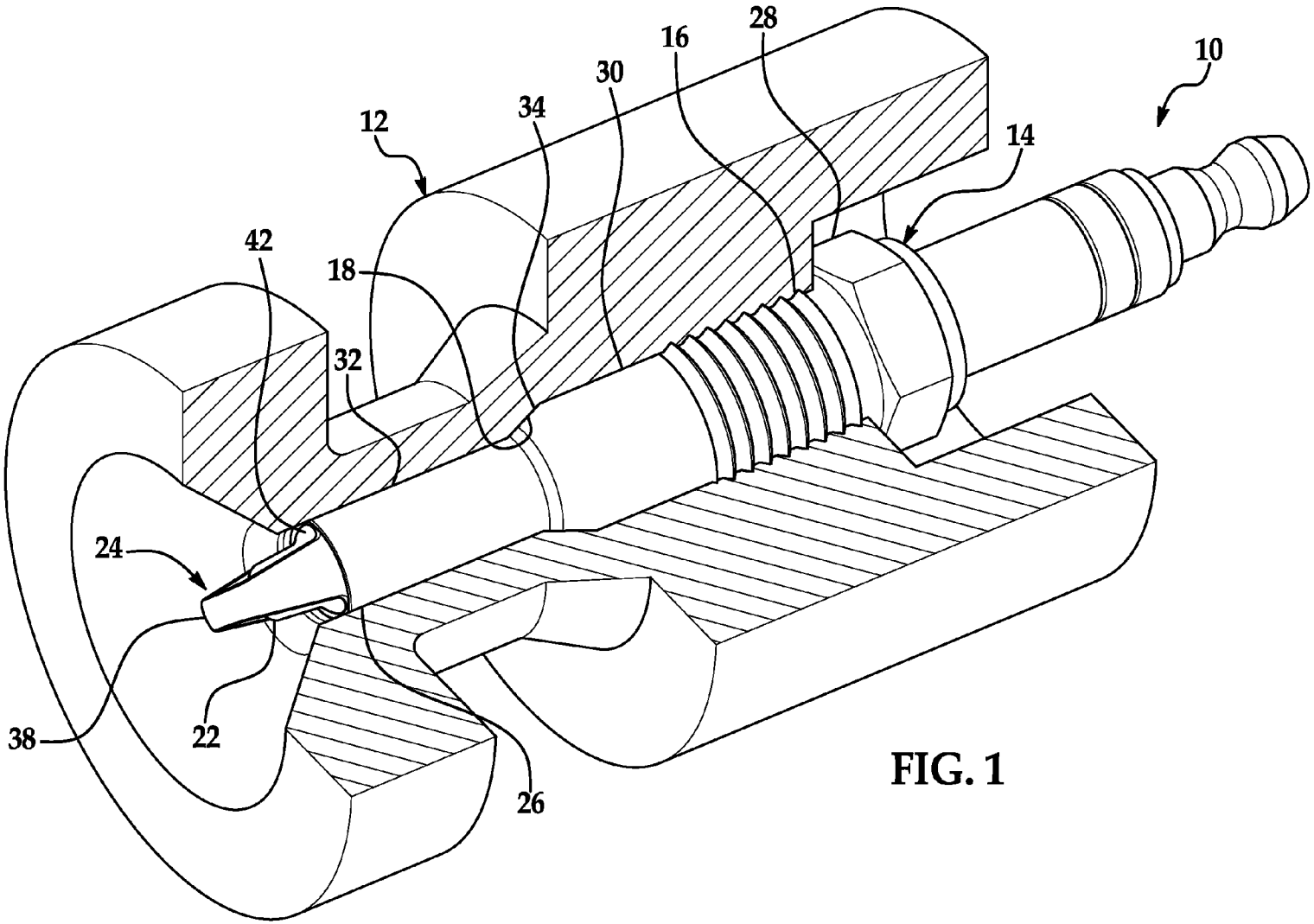
FIG. 1 is a perspective cutaway view of a cylinder head having a spark plug with a spark plug casing, according to a non-limiting exemplary embodiment of the invention.

Referring to FIG. 1, there is shown a perspective cutaway view of a spark plug 10 installed in a cylinder head 12. The spark plug has a casing 14 with a high thread ("HT") design, which includes a threaded fastener 16 configured to be disposed above a seat 18 of the cylinder head and force a portion of the casing against the seat, rather than be disposed beneath the seat and pull the casing onto the seat. Accordingly, combustion gases are more efficiently sealed in a combustion chamber of the engine and more space is available in the combustion chamber for optimizing engine design, e.g. installation of larger valves.

Figure 2:
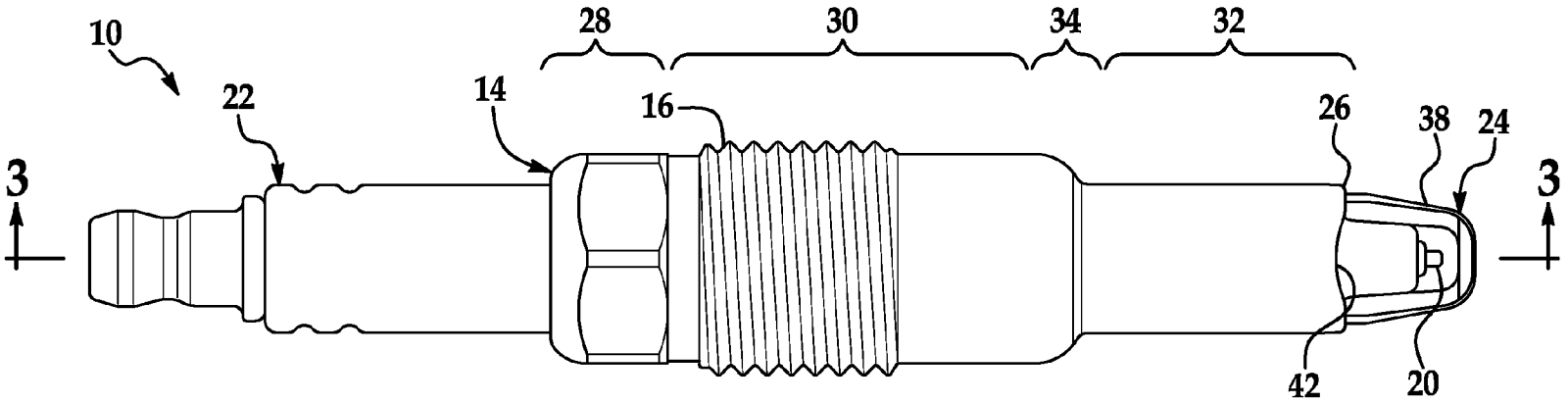
FIG. 2 is side plan view of the spark plug of FIG. 1.
Figure 3:
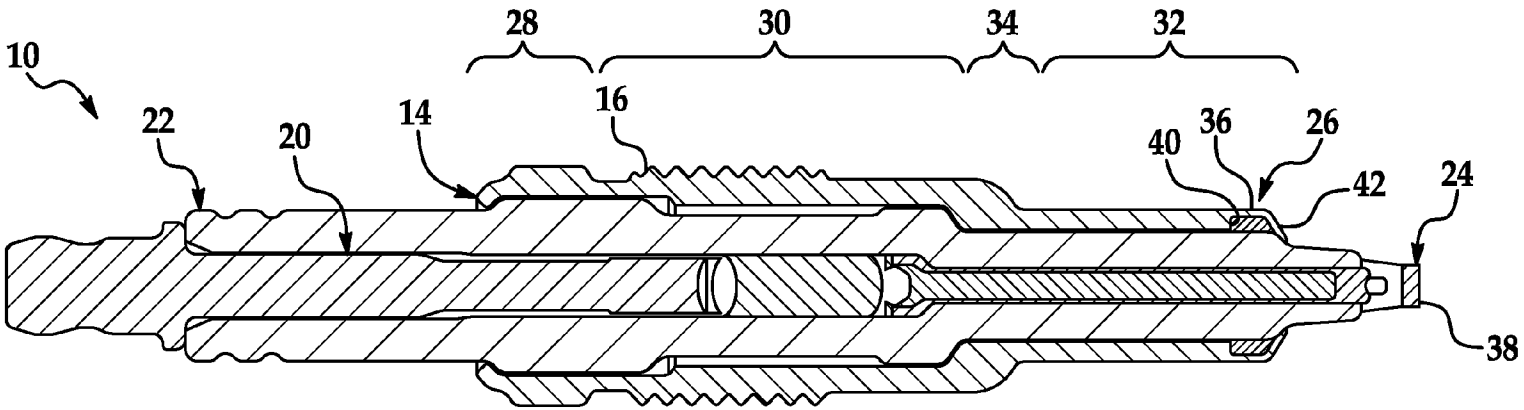
FIG. 3 is a cross-sectional view of the spark plug of FIG. 2, as taken along line 3-3.
Figure 4:
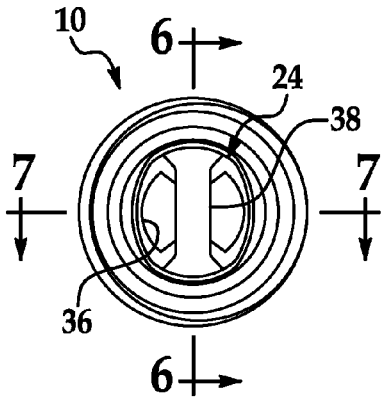
FIG. 4 is an axial view of the spark plug of FIG. 2.

Referring to FIGS. 2 through 4, the spark plug includes a center electrode 20, an insulator 22 disposed about the center electrode and casing 14 disposed about the insulator.

Figure 5A:
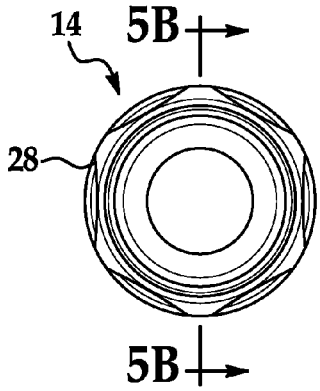
FIG. 5A is an axial end view of the spark plug casing of FIG. 5.
Figure 5:
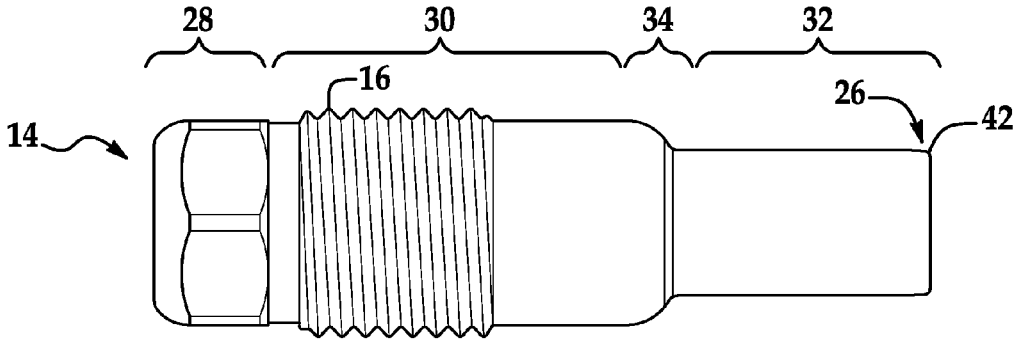
FIG. 5 is a side plan view of the spark plug casing of FIG. 1.
Figure 5B:
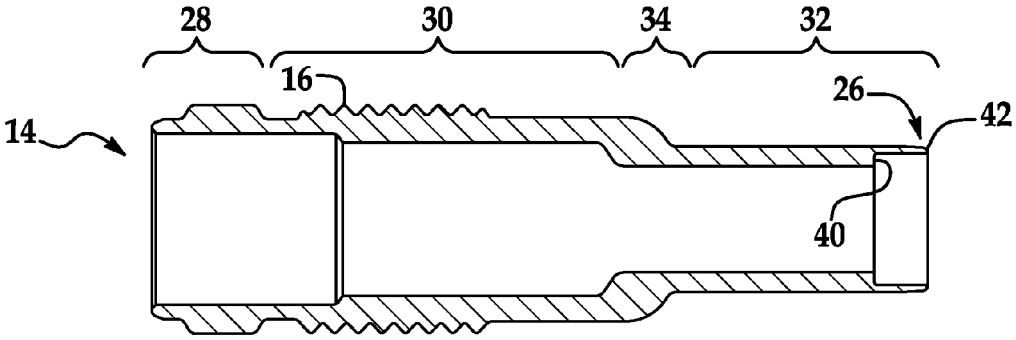
FIG. 5B is a cross-sectional view of the spark plug casing of FIG. 5A, as taken along line 5B-5B.

Referring to FIGS. 5, 5A and 5B and in accordance with an exemplary embodiment of the present invention, the casing is a single-piece shell integrally formed with a nut portion 28 and a first tubular portion 30 extending from the nut portion. The first tubular portion has a first cross-sectional size and a threaded fastener 16 configured to attach the casing to the cylinder head.

The casing further includes an integrally formed second tubular portion 32 having a second cross-sectional size that is less than the first cross-sectional size. The second tubular portion is configured to extend toward a combustion chamber past the cylinder head.

The casing further includes an integrally formed converging shell portion 34 coupled between the first tubular portion and the second tubular portion. The converging shell portion is configured to be received within seat 18 of the cylinder head for sealing combustion gases within the combustion chamber of the engine. In the depicted embodiment, the converging shell portion is formed from two consecutive frustoconical portions of the casing. However, it is contemplated that the converging shell portion can instead be formed from more or less than two frustoconical portions or have a variety of other suitable shapes tapering in cross-sectional size from the first tubular portion to the second tubular portion.

Figure 6:
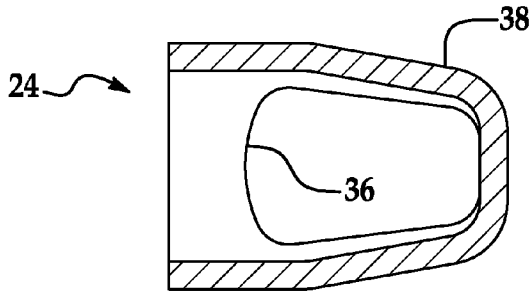
FIG. 6 is a cross-sectional view of the ground strap of FIG. 4, as taken along line 6-6.
Figure 7:
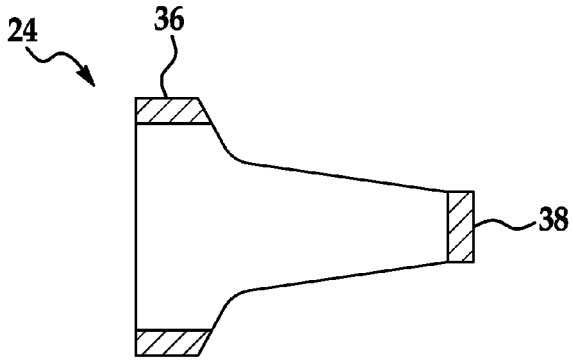
FIG. 7 is a cross-sectional view of the ground strap of FIG. 4, as taken along line 7-7.
Figure 8:
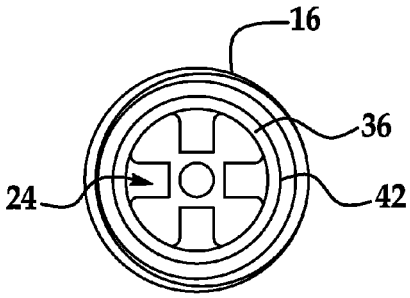
FIGS. 8-11 are axial views of ground straps according to various alternative exemplary embodiments of the present invention.
Figure 9:
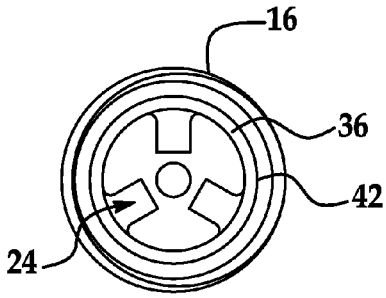
Figure 10:
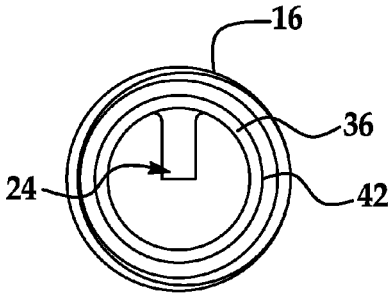
Figure 11:
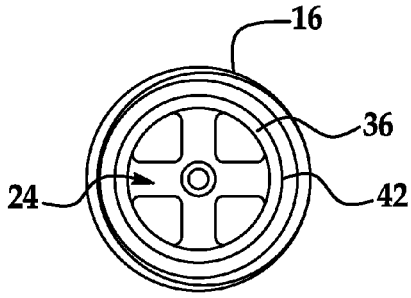

The casing further includes a separately formed ground strap 24 (See for example FIGS. 6 and 7) that is secured to the single-piece shell and extends from an end portion 26 of the second tubular portion opposite the converging shell portion. The ground strap illustrated in FIGS. 6 and 7 has a ring portion 36 and an arcuate loop 38 extending across the ring portion (e.g., from one portion to another). The arcuate loop and the center electrode are in a spaced relationship with respect to each other for defining a spark gap therebetween. The ring portion has a third cross-sectional size that is less than the second cross-sectional size of the second tubular portion, such that the end portion of the second tubular portion is configured to receive the ring portion therein. As illustrated, the end portion of the second tubular portion includes a seat 40 and a rim portion 42. The ring portion is received within the seat and crimped between the seat and the rim portion. Accordingly, rim portion 42 is crimped over ring portion 36 to secure the same to the single-piece shell. It is further contemplated that the ground strap can instead be fixedly attached to the rim portion by spot welding, brazing, laser welding or other suitable attachment method.

Accordingly, the ground strap and the cylinder head are in a spaced relationship with respect to each other for preventing carbon from building up on the ground strap and binding the ground strap to the cylinder head. In this way, the spark plug is configured to be removed from the cylinder head without the ground strap or other portions of the casing remaining lodged in the cylinder head.

The casing, insulator and electrode are configured to be preassembled together and then placed in a fixture for attaching the ground strap to the casing in a predetermined position. Accordingly, the spark gap is located in a predetermined location with respect to other portions of the spark plug, and the step of determining the location of the spark gap is eliminated when indexing the spark plug. In other words, the ground strap will be added after the assembly of the other components of the plug and plug indexing will occur after the final assembly of the spark plug.

In this non-limiting embodiment and since the ground strap is separately formed, the ground strap is made of a high nickel alloy and has a first length. Further, the second tubular portion is made of a lower cost metal than high nickel alloy and has a second length, which is greater than the first length. Accordingly, the casing and the ground strap reduce the overall material costs of the spark plug.

Referring now to FIGS. 8-11 axial views of alternative ground straps are illustrated here the ground strap may be open in the center (FIGS. 8 and 9), a traditional "J" strap (FIG. 10) or intersecting members (FIG. 11) wherein an opening is provided therein. Again, the separately formed ground straps are formed from higher cost materials and separately secured to the integral casing of lower cost materials reducing the overall costs of the spark plug. As discussed, above each of the alternative ground straps would have a ring member 36 that is received in seat 40 and portion 42 is crimped over. Accordingly, all of the various embodiments of the alternative ground straps would depend away from a portion received and engaged within seat 40. Reference is also made to the following U.S. Pat. Nos. 5,918,571; 5,697,334; and 6,104,130 the contents each of which are incorporated herein by reference thereto, wherein the aforementioned patents illustrate various ground strap configurations contemplated to be used with exemplary embodiments of the present invention.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the present application.

What is claimed is:

1. A method of making a spark plug casing, comprising:

forming a first main shell portion having a nut portion; a first tubular portion extending from the nut portion, the first tubular portion having a first cross-sectional size and a threaded fastener configured to attach the spark plug casing to a cylinder head; a second tubular portion having a second cross-sectional size, the second cross-sectional size being less than the first cross-sectional size, the second tubular portion configured to extend toward a combustion chamber past the cylinder head; and securing a converging shell portion to the first main shell portion, the converging shell portion being coupled between the first tubular portion and the second tubular portion, wherein the nut portion, the first tubular portion, the second tubular portion and the converging shell portion are formed from a single-piece shell such that the single-piece shell is configured to be removed from the cylinder head as an integral device; and a ground strap having a third cross-sectional size, the third cross-sectional size being less than the second cross-sectional size, the ground strap being received within and fixedly secured to an end portion of the second tubular portion opposite the converging shell portion, such that the ground strap and the cylinder head are in a spaced relationship with respect to each other for preventing a buildup of carbon from binding the ground strap to the cylinder head.

2. The method as in claim 1, wherein the end portion of the second tubular portion has a seat configured to receive the ground strap, wherein the seat of the second tubular portion is proximate to a distal end of the spark plug casing.

3. The method as in claim 2, wherein the ground strap has a ring portion and an arcuate loop extending across the ring portion, the ring portion being disposed within the seat, and the arcuate loop and the center electrode being in a spaced relationship with respect to each other for defining a spark gap therebetween.

4. The method as in claim 3, wherein the end portion of the second tubular portion has a rim portion extending past the seat, the rim portion being attached to the ring portion.

5. The method as in claim 4, wherein the rim portion is welded to the ring portion.

6. The method as in claim 4, wherein the ring portion is crimped between the rim portion and the seat.

7. The method as in claim 1, wherein the ground strap is made of a high nickel alloy.

8. The method as in claim 7, wherein the ground strap has a first length, and the second tubular portion has a second length, and the second length being greater than the first length.

9. A method of manufacturing a spark plug, comprising:

forming a spark plug assembly having a center electrode; an insulator disposed about the center electrode; and a spark plug casing disposed about the insulator, the spark plug casing having a nut portion, a first tubular portion, a second tubular portion, a converging shell portion, the first tubular portion extending from the nut portion, the first tubular portion having a first cross-sectional size and a threaded fastener configured to attach the spark plug casing to a cylinder head, the second tubular portion having a second cross-sectional size, the second cross-sectional size being less than the first cross-sectional size, the second tubular portion configured to extend toward a combustion chamber past the cylinder head, the converging shell portion coupled between the first tubular portion and the second tubular portion, wherein the nut portion, the first tubular portion, the second tubular portion and the converging shell portion are formed from a single-piece shell such that the single-piece shell is configured to be removed from the cylinder head as an integral device; and securing a ground strap to the spark plug assembly, the ground strap having a third cross-sectional size, the third cross-sectional size being less than the second cross-sectional size, the ground strap being received within and fixedly secured to an end portion of the second tubular portion opposite the converging shell portion, such that the ground strap and the cylinder head are in a spaced relationship with respect to each other for preventing a buildup of carbon from binding the ground strap to the cylinder head and wherein the seat of the second tubular portion is proximate to a distal end of the spark plug casing, wherein only a tip portion of the insulator extends past the distal end of the spark plug casing.

10. The method as in claim 9, wherein the end portion of the second tubular portion has a seat configured to receive the ground strap.

11. The method as in claim 10, wherein the ground strap has a ring portion and an arcuate loop extending across the ring portion, the ring portion being disposed within the seat, and the arcuate loop and the center electrode being in a spaced relationship with respect to each other for defining a spark gap therebetween.

12. The method as in claim 11, wherein the end portion of the second tubular portion has a rim portion extending past the seat, the rim portion being attached to the ring portion.

13. The method as in claim 12, wherein the rim portion is welded to the ring portion.

14. The method as in claim 12, wherein the ring portion is crimped between the rim portion and the seat.

15. The method as in claim 9, wherein the ground strap is made of a high nickel alloy.

16. The method as in claim 15, wherein the ground strap has a first length, and the second tubular portion has a second length, and the second length being greater than the first length.

* * * * *